US006220978B1

(12) United States Patent
Schroeder

(10) Patent No.: US 6,220,978 B1
(45) Date of Patent: Apr. 24, 2001

(54) ARROW FLETCHING

(76) Inventor: Bernard J. Schroeder, 6137 Mullen Rd., Cincinnati, OH (US) 45247

( * ) Notice: Subject to any disclaimer, the term of this patent is extended or adjusted under 35 U.S.C. 154(b) by 0 days.

(21) Appl. No.: 09/536,434

(22) Filed: Mar. 27, 2000

(51) Int. Cl.[7] ..... F42B 6/06
(52) U.S. Cl. ..... 473/586
(58) Field of Search ..... 473/578, 585, 473/586, FOR 216, FOR 220, FOR 223

(56) References Cited

U.S. PATENT DOCUMENTS

| | | | | |
|---|---|---|---|---|
| 3,539,187 | * | 11/1970 | Smith | 473/586 |
| 3,595,579 | | 7/1971 | Benoit | 473/586 |
| 3,749,403 | | 7/1973 | Austin et al. | 473/586 |
| 3,815,916 | | 6/1974 | Meszaros | 473/586 |
| 3,895,802 | | 7/1975 | Bear | 473/586 |
| 3,922,401 | | 11/1975 | Bear | 427/290 |
| 4,012,043 | * | 3/1977 | Carella | 473/586 |
| 4,088,323 | | 5/1978 | Munger | 473/586 |
| 4,136,144 | | 1/1979 | Munger | 264/161 |
| 4,204,307 | | 5/1980 | Pfetzing | 29/407 |
| 4,392,654 | | 7/1983 | Carella | 473/586 |
| 4,477,084 | * | 10/1984 | Austin | 473/586 |
| 4,502,692 | * | 3/1985 | Humphrey | 473/586 |
| 4,510,109 | | 4/1985 | Carella | 264/151 |
| 4,615,552 | * | 10/1986 | Bengtson | 473/586 |
| 5,039,110 | | 8/1991 | Honda | 473/586 |
| 5,465,981 | | 11/1995 | Klaus | 473/586 |
| 5,613,688 | | 3/1997 | Carella | 473/586 |

* cited by examiner

*Primary Examiner*—John A. Ricci
(74) *Attorney, Agent, or Firm*—Michael C. Connelly

(57) ABSTRACT

Arrow fletching constructed from Ethylene Vinyl Acetate (EVA) foam which is also known and commonly sold as craft foam. The arrow fletching is preferably cut from sheet stock of EVA foam to any standard or otherwise desired profile, then adhered to the shaft of an arrow in any desired position or configuration so as to provide an arrow with a weight and speed comparable to the weight and speed of a feather fletched arrow, while at the same time having the toughness, durability and weatherproof qualities of plastic fletched arrows.

4 Claims, 1 Drawing Sheet

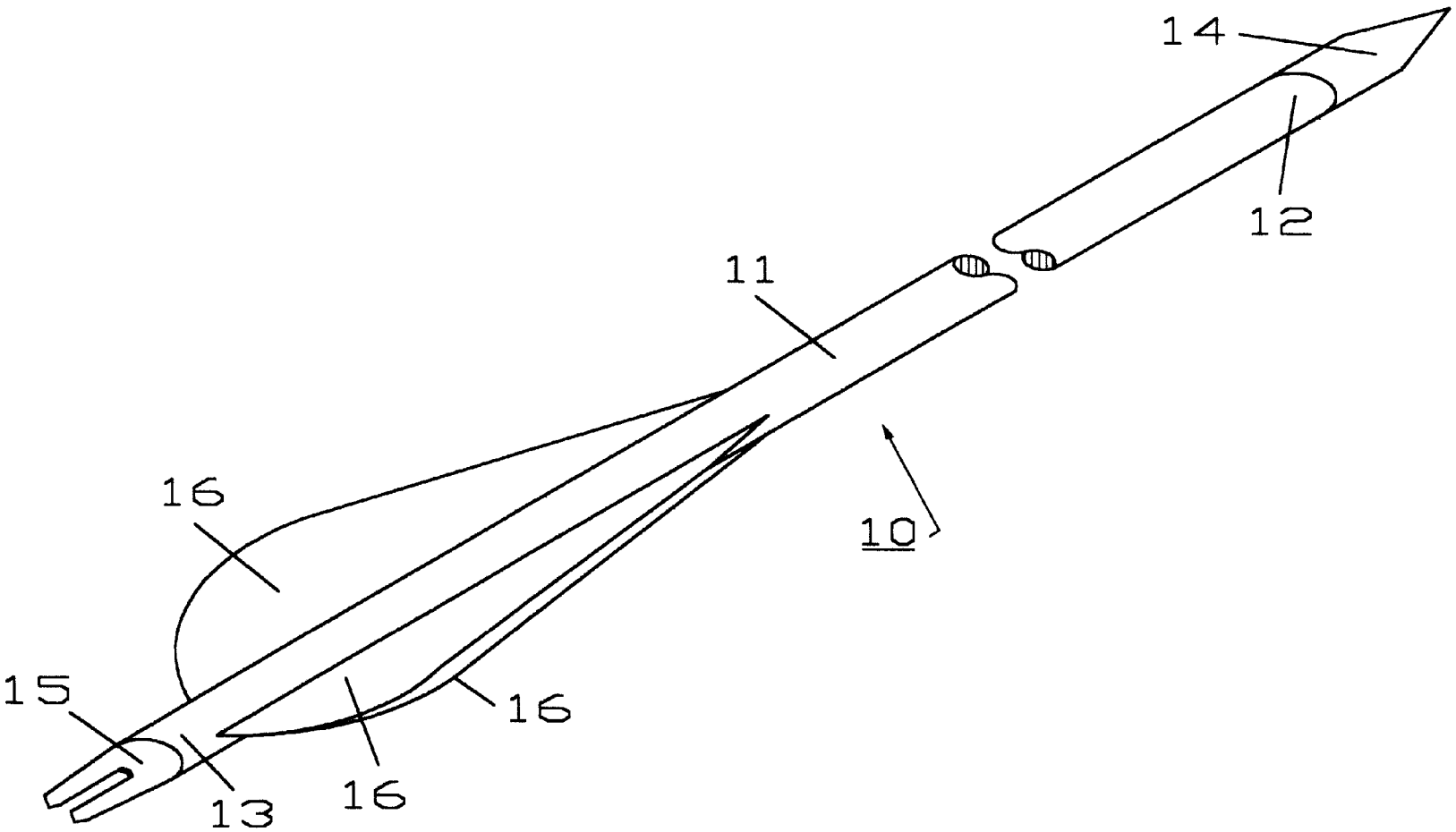
14
12
10
11
16
16
16
13
15

ARROW FLETCHING

BACKGROUND

This invention relates to arrow fletching, specifically to arrow fletching constructed of synthetic materials and particularly to arrow fletching fabricated from a man-made material that has the advantages of both synthetic fletching and fletching made from feathers.

In archery, whether hunting or shooting competitively, the archer needs to be able to rely on the steering and stability of the arrow during flight. Steering and stability provide accuracy and speed to the arrow and are created, to a great extent, by the fletching of the arrow. In the past, fletching was made from feathers and then later from various types of plastic and rubber compounds such as polyester, mylar and polyurethane.

Feathers are very light and, when used for fletching, help provide greater speed to an arrow than do the heavier plastic fletching. Such feather fletching equipped arrows, due to their lighter weight, are faster at greater distances and thereby more accurate farther down range. Feathers, however, do have some disadvantages. Feathers are very delicate and damage easily due to rough treatment or passing through or against an object. When damaged, feathers cannot be repaired, but rather must be completely replaced. Such replacement can be expensive, difficult and time consuming. Feathers are not weatherproof. Wet weather conditions can hamper the performance of, if not completely ruin, feather fletching on arrows. Arrows utilizing feather fletching perform well for competitive archers, since weather and obstacles down range are not a problem. However, in other archery applications feather fletching is not the best choice.

In bow hunting, for example, weather and obstacles must be taken into account when designing arrow fletching. Synthetic fletching helps address some of these problems. Many types of plastics have been used as arrow fletching and as a group eliminate some of the drawbacks of feathers. Plastic fletching is more durable, resilient and weatherproof than feathers. Plastics are better able to stand up to typical field conditions, such as rain, snow and brush obstacles, than are feathers. Plastic fletching does not deform as much as feather fletching when passing through or against an object, however, some deformation does still occur with plastic fletching which often cannot be repaired, thereby necessitating a replacement of fletching or arrow. Plastics are also less expensive and easier to work with than are feathers when used as fletching.

The major disadvantage of plastic fletching is its weight. Plastics are considerably heavier than feathers and, as such, when used as fletching add weight to the arrow. This extra weight makes the arrow slower, thereby reducing accuracy and the speed at which the arrow can stabilize itself after passing through an object or encountering a cross wind during flight. For a hunter, the speed and stabilizing time of the arrow often determine whether or not the hunt is successful.

As stated above, plastic fletching will deform somewhat when passing through objects. This is a common problem in hunting where there is often brush that must be shot near to or through. Fletching can also be damaged when the arrow strikes game. Plastic fletching is tougher than feathers but often still is permanently damaged or deformed during use to the point that the fletching or the entire arrow must be replaced. As with feather fletched arrows, such replacement can be expensive, inconvenient, difficult and time consuming.

For the foregoing reasons there is need for an arrow fletching that combines the lightweight, and thereby speed, of an arrow equipped with feather fletching and the durability, toughness and weatherproof qualities of plastic fletching, such arrow fletching being inexpensive, simple and easy to manufacture and repair and filling the needs of all types of archers.

SUMMARY

The present invention is directed to an arrow fletching that is lightweight, durable, tough, weatherproof, inexpensive, simple and easy to manufacture and repair and that fulfills the needs of all types of archers. To obtain these objectives the arrow fletching is composed of Ethylene Vinyl Acetate foam otherwise known as EVA foam. The arrow fletching fabricated from EVA foam is able to be made in any desired profile and mounted to a shaft of an arrow in any desired configuration.

Ethylene Vinyl Acetate foam is commonly marketed as craft foam. EVA foam is easy to acquire and inexpensive. It is available at craft stores or many other stores where craft or children's products are sold. EVA foam is sold in thin sheets and is designed to be easily cut up into shapes and glued to itself or other objects, and in general is very easy to work with. EVA foam is lightweight, durable and waterproof. These factors and others make Ethylene Vinyl Acetate foam adaptable to, and a superior choice for, fabrication into arrow fletching.

EVA foam is considerably more lightweight than plastics such as polyester, polyurethane, polyvinyl chloride or other artificial materials used in the past as arrow fletching. In fact, fletching made from EVA foam is comparable in weight to fletching made of natural feathers. This makes an arrow equipped with EVA foam fletching as light as a feather fletched arrow and therefore as fast. Not only are EVA foam fletched arrows as fast as feather fletched arrows, but they retain their speed longer and are faster farther down range than feather fletched arrows. And since lighter arrows stabilize faster than heavier arrows, EVA foam fletched arrows will stabilize as quickly as feather fletched arrows and quicker than arrows equipped with plastic or other artificial fletching. In short, arrows fitted with EVA foam fletching have the feather fletched arrow advantage of lighter weight, and thereby greater speed and quicker stabilization over heavier and slower plastic fletched arrows.

EVA foam is tough, durable and weatherproof. Such factors are important to archers when choosing equipment and are vital for dependable and long lasting arrow fletching. EVA foam is waterproof and remains pliable after being frozen and thereby lends itself well to being used as a weatherproof arrow fletching material. Arrow fletching constructed from EVA foam doesn't damage or tear easily due to normal or rough use. This toughness allows the EVA foam fletching to stand up longer to use and increases durability and extends the life of the arrow fletching. Permanent deformation doesn't occur to EVA foam fletched arrows after so equipped arrows pass through an object, but instead, the EVA foam fletching has a "memory" and will spring back to its original shape in most instances after bending, compression or tension. If the EVA foam fletching does not spring back, due to excessive stress, the fletching often can be rubbed or pressed back in the field to its original shape. In this manner EVA foam fletching is repairable without having to completely replace the fletching or entire arrow, thus saving time and expense.

In the preferred embodiment of the invention the EVA foam fletching is not composed of one piece, but, instead, of a plurality of individual and separate fletchings. The EVA foam fletching is constructed from sheet material of EVA foam, as stated above, available, inexpensively, as craft foam at most stores. The sheet material is available in various thickness and colors giving the user a choice as to color and style of the EVA foam fletching. The individual fletchings are then laid out on, and cut from, the EVA foam sheet in any desired size, profile or number. Different types of archery require different shapes of fletching. All can be accommodated with EVA foam sheet. After removal from the EVA foam sheet the individual fletchings are then attached separately to the shaft of an arrow in any desired position or configuration. The EVA foam fletching is adhered to the arrow shaft using any of a number of adhesives such as glue, spray adhesive or tape. EVA foam sheet is very easy to work with. It cuts easily and many adhesives are compatible with it. Fletching made from EVA foam sheet can easily and simply be used with any type of arrow shaft regardless of the material used in the arrow shaft's construction.

Above all, the use of EVA foam as arrow fletching allows great versatility. EVA foam fletched arrows are lightweight, fast in flight and stabilize quickly which are qualities that both competitive archers and hunters both seek. EVA foam fletching is also tough, durable, weatherproof, pliable and repairable which are factors that are beneficial to hunters. Versatility is likewise achieved by the fact that EVA foam fletching can be simply fabricated into and desired shape and easily and quickly mounted in any configuration and number on any of the various types and materials of arrow shafts.

In short, the desired objectives of an arrow fletching that is lightweight, durable, tough, weatherproof, inexpensive, simple and easy to manufacture and repair while fulfilling the needs of all archers are fully achieved by the present invention. The use of EVA foam as arrow fletching accomplishes these goals and others as explained above. These and other features, aspects and advantages of the present invention will become better understood with reference to the following description and appended claims.

BRIEF DESCRIPTION OF THE DRAWINGS

The FIGURE shows a perspective view of an arrow equipped with Ethylene Vinyl Acetate foam fletching.

DESCRIPTION

As shown in FIG. 1 an arrow 10 comprises a shaft 11, said shaft 11 having a front end 12 and a rear end 13 said rear end 13 being opposite of said front end 12. A tip 14 is connected to said front end 12 of said shaft 11 and a nock 15 is affixed to said rear end 13 of said shaft 11. A plurality of fletchings 16, fabricated from Ethylene Vinyl Acetate foam, commonly known as EVA foam, and marketed as craft foam, is adhered to said shaft 11 in any standard or other desired configuration, thereby giving said arrow 10, the advantages of light weight and speed of an arrow equipped with feather fletching and also the durability, toughness and weatherproof qualities of an arrow fitted with plastic fletching. As will become apparent below, said arrow 10 equipped with said plurality of fletchings 16 made from Ethylene Vinyl Acetate (EVA) foam increases versatility, performance and cost effectiveness over other arrows using different materials for their respective fletching.

Fletching is a generic term used to describe the fins found on an arrow that guide and stabilize the arrow. These fins, when made out of natural feathers, are commonly referred to as fletching as a group, and fletches individually. When made out of plastic or other man-made materials these fins are called vanes. Here the terms fletching and fletchings will be employed throughout when describing these fins.

In the preferred embodiment, still in FIG. 1, said shaft 11 is substantially cylindrical and any desired or standard length. Said shaft 11 can be composed of any material normally used for arrow shafts, such as aluminum, wood or carbon fiber. Said plurality of fletchings 16, made from EVA foam, work equally well with all these shaft materials giving such equipped arrows superior performance and versatility. Each of said plurality of fletchings 16 of EVA foam are adhered individually toward said rear end 13 of said shaft 11 using glue, epoxy, adhesive tape or other cements. Said fletching 16 can be best mounted to said shaft 11 employing a standard fletching jig. Said plurality of fletching 16 can simply be attached to said shaft 11, not only on said rear end 13, but wherever wanted and in whatever configuration and number needed depending on the archery conditions and requirements.

The improvement provided by the present invention results from the material choice for said fletching 16. As stated above said fletching 16 is to be fabricated from Ethylene Vinyl Acetate (EVA) foam. In the preferred embodiment said fletching 16 is cut from sheet stock of EVA foam. The EVA foam is commonly and inexpensively available in many stores and can be found in various thicknesses and colors. EVA foam is also easy to cut and to work with. Said fletching 16 that is cut from the EVA foam can be cut in any profile and shape by the archer. Each of said plurality of fletchings 16 is then adhered to said shaft 11 of said arrow 10, using a choice of glues, in any desired position. Said fletching 16 can be cut from EVA foam sheet to a preferred profile and mounted to said shaft 11 in a certain configuration for a specific type of archery or field condition. EVA foam is compatible to a wide variety of adhesives giving a user even more choice. The present invention allows a matching of fletching profile and configuration, shaft material type and adhesive to meet the needs of any type of archery.

Said fletching 16 made from EVA foam is also repairable in many cases. When said fletching 16 made from EVA foam is deformed when passing through an object or during handling it can be repaired by rubbing or pressing it back to its original shape, and often over time said fletching 16 will return to its former shape on its own due to the "memory" of the EVA foam caused by the elasticity and resiliency of this material. This reparability of said fletching 16 is due to the toughness and the resiliency of the EVA foam. EVA foam does not tear easily and is more durable than other materials used as arrow fletching. And if said fletching 16 tears, is permanently deformed or simply wears out said fletching 16 can easily and cheaply be removed from said shaft 11 and replaced.

Said fletching 16 made of EVA foam also repels water rather than soaks it up, meaning the performance of said fletching 16 will not be adversely affected by wet weather. Also, when subjected to extreme cold said fletching 16 does not freeze, but, instead remains pliable. These two factors make said arrow 10 with said fletching 16 made of EVA foam ideal for the use of hunters in the field.

Thus it is seen that the present invention provides an improved and versatile arrow for use by all different types of archers and under differing conditions. As stated above, the present invention is very versatile. The present invention has both the advantages of light weight and speed of arrows with feather fletching and the durability, toughness, resiliency and weatherproof qualities of plastic fletching. And beyond these, the present invention is inexpensive, easily repairable and simple.

While this invention has been disclosed with reference to its present preferred embodiment, it is not limited thereto. Rather, this invention is limited only insofar as defined by the following set of claims and includes within its scope all equivalents thereof.

I claim:

1. An arrow comprising, a shaft, said shaft being substantially cylindrical and said shaft having a front end and a rear end; and a plurality of fletchings adhered to said shaft wherein said plurality of fletchings is fabricated of Ethylene Vinyl Acetate (EVA) foam.

2. An arrow as defined in claim 1 wherein each of said plurality of fletchings is cut from a sheet of said Ethylene Vinyl Acetate (EVA) foam in any desired profile and is mounted to said shaft in any desired configuration by a user.

3. An arrow fletching comprised of Ethylene Vinyl Acetate (EVA) foam; said arrow fletching being fabricated to desired profiles and mounted as desired on a shaft of an arrow.

4. An arrow fletching as defined in claim 3 constructed of sheet stock of said Ethylene Vinyl Acetate (EVA) foam, said arrow fletching being cut from said sheet stock of said Ethylene Vinyl Acetate (EVA) foam.

* * * * *